US008814468B1

(12) United States Patent
Willcox

(10) Patent No.: US 8,814,468 B1
(45) Date of Patent: Aug. 26, 2014

(54) DYNAMIC ROLL/PITCH STABILIZER FOR USE DURING LOADING AND UNLOADING OF SMALL PASSENGER BOATS

(71) Applicant: Disney Enterprises, Inc., Burbank, CA (US)

(72) Inventor: William W. Willcox, Simi Valley, CA (US)

(73) Assignee: Disney Enterprises, Inc., Burbank, CA (US)

( * ) Notice: Subject to any disclaimer, the term of this patent is extended or adjusted under 35 U.S.C. 154(b) by 66 days.

(21) Appl. No.: 13/764,950

(22) Filed: Feb. 12, 2013

(51) Int. Cl.
*B63C 5/04* (2006.01)
*B63B 39/00* (2006.01)

(52) U.S. Cl.
CPC ..... *B63B 39/00* (2013.01)
USPC ..... 405/7; 114/230.1

(58) Field of Classification Search
CPC ..... B63B 27/36; B63C 5/04
USPC ..... 405/7; 114/231, 230.1, 44–48
See application file for complete search history.

(56) References Cited

U.S. PATENT DOCUMENTS

| | | | | |
|---|---|---|---|---|
| 1,220,551 | A | 3/1917 | Powell et al. | |
| 3,139,732 | A | 7/1964 | Thompson | |
| 3,404,635 | A | 10/1968 | Bacon et al. | |
| 3,721,096 | A * | 3/1973 | Deckert et al. | 405/7 |
| 3,865,041 | A | 2/1975 | Bacon | |
| 3,991,695 | A | 11/1976 | McDonald | |
| 4,072,119 | A | 2/1978 | Williams | |
| 4,149,469 | A | 4/1979 | Bigler | |
| 4,756,642 | A * | 7/1988 | Quinn et al. | 405/7 |
| 5,033,392 | A | 7/1991 | Schemitsch | |
| 5,197,923 | A | 3/1993 | Barber | |
| 7,028,630 | B2 | 4/2006 | Metz | |
| 7,082,887 | B2 | 8/2006 | Fuller | |
| 7,444,954 | B1 | 11/2008 | Resta | |
| 8,112,198 | B2 | 2/2012 | Parison, Jr. | |
| 8,197,352 | B2 | 6/2012 | Henry | |
| 2009/0179122 | A1 | 7/2009 | Inzero | |

FOREIGN PATENT DOCUMENTS

JP 03231094 A * 10/1991 ..... B63C 1/10

* cited by examiner

*Primary Examiner* — Edwin Swinehart
(74) *Attorney, Agent, or Firm* — Marsh Fischmann & Breyfogle LLP; Kent A. Lembke

(57) ABSTRACT

A small boat dynamic roll stabilizer. The stabilizer includes two or more pairs of spaced-apart flexible bellows or air bags to receive and support a boat hull during passenger loading and unloading. Dynamic pitch is limited or even stopped for the boat hull by maintaining each of the bellows, which each has a contact surface contacting a portion of the hull from below (within the water), at an internal pressure great enough to support dynamic loading of the boat hull while allowing the water to support the hull's static load. A pressure chamber is provided that has its interior volume linked via ducting or piping with the bellows, and a controller uses a feedback loop to operate an actuator to move a piston within the pressure chamber to maintain the pressure of the chamber and linked bellows as the loading of the boat hull dynamically varies during loading and unloading.

22 Claims, 5 Drawing Sheets

DYNAMIC ROLL/PITCH STABILIZER FOR USE DURING LOADING AND UNLOADING OF SMALL PASSENGER BOATS

BACKGROUND

1. Field of the Description

The present invention relates, in general, to small passenger boats (e.g., boats for carrying 1 to 50 or more passengers) and to equipment that facilitates the loading and unloading of passengers from such boats when they are positioned near a dock, and, more particularly, to methods and systems for stabilizing a passenger boat to allow safe loading and unloading of passengers while the boat is adjacent to a dock (e.g., any platform positioned along a body of water).

2. Relevant Background

There are numerous applications where relatively small passenger boats are loaded and unloaded from docks, and this loading and unloading may be performed numerous times each day. For example, amusement parks often feature a number of water rides that may be designed to provide one or more passenger boats floating along a stream of water in a channel and, in some cases, each of the boats is guided from underneath using a track, which is provided at the bottom of the channel. These water rides may be gentle rides, such as rides used to provide a show or an outdoor adventure, or may include thrill portions where the boats travel quickly through rapids. In each of these settings, the boat typically is guided in a manner that allows the boat to float in the water with the boat and its passengers experiencing pitch and other common boat-related or floating dynamics (such as roll or yaw).

Passenger safety has represented one of the main challenges for designers of water rides. Safety is of particular concern for passenger boats when the passengers are loading the boat from a dock and also when they later unload the boat and have to step from the boat onto the dock. For example, a passenger boat may have its movements generally guided by a connection to a track on a channel bottom. However, even when tied up to a dock, the boat has some freedom of movement as it can bob up and down in the water and roll side to side so that the ride more fully simulates a true boating experience.

More specifically, amusement parks often use self-propelled and free-floating boats in their excursion and other rides. Small, self-propelled, free-floating boats with relatively large passenger capacities are, in general, dynamically unstable in roll and pitch motion during the load and unload processes. As passengers embark and disembark, they must step into or out of the boat from or onto an adjacent dock (e.g., the upper, planar surface of a dock or platform). Since their first or last point of support is usually the side of the boat or a top step inside of the boat, the stepping into and out of action by the passengers induces a transient dynamic roll or pitch moment in the boat as a concentrated load is placed on the outer edges of the boat. In other words, the boat sinks into the water as a person steps onto it and rises as the passenger steps out of the boat.

There is usually a clearance gap or space between the side of the boat and outer edge (or boat-facing side) of the dock, and the size of this gap or space that the passenger has to step over to safely reach the dock changes as the boat moves in response to passenger movement and also in response to water movement. Depending on the load in the boat, the height of the final step onto the dock (or off of the dock into the boat) will also change with the passenger movements and the resulting roll and pitch moments. The passenger may find the motion between the boat and dock disorienting or otherwise may have difficulty adjusting to the changing gap and/or height. This can create a safety hazard for the boat passengers, and operators of water rides continue to be concerned that passengers may experience injuries due to falls either into the boat, into the gap and water, or onto the dock.

Presently, operators of water rides attempt to position the guiding track (if there is one) so as to place the boat very near to the dock, and safety is improved by fastening the boat to the dock during loading and unloading. However, the boat typically can still move, which causes the gap and height of the boat to vary a significant amount during loading and unloading as passengers step on or near the edge of the boat and then off the boat onto the dock (or vice versa for loading). Hence, there remains a need for systems and methods for stabilizing small passenger boats to eliminate or at least better control the amount of dynamic movement (e.g., dynamic pitch) the boat experiences during loading and unloading.

Such a stabilizing system or assembly may be adapted for rapidly stabilizing the boat (or its hull) and then releasing the boat to allow the boat to move away from the dock, and such speed may be even more desirable in amusement parks interested in high passenger throughput. However, the stabilizing system may be useful in nearly any application in which a boat is positioned along a dock for loading and unloading where passengers are expected to step onto or from the boat and where the varying step height (relative height of the dock compared to the boat) and clearance gap may be considered a potential hazard.

SUMMARY

The following description addresses the above and other issues involved in safely loading and unloading smaller passenger boats by teaching a small boat dynamic roll/pitch stabilizer (or stabilizing system). The inventors recognized that boat hulls are specifically designed for relatively equal and even application of pressure or forces on their lower surface such that anything else causes potentially damaging stresses. With this in mind, the stabilizing system uses two or more pairs of air bellows or air bags to provide four or more contact surfaces that are relatively large (e.g., each is 1 square foot or more) and compliant to the shape of the boat hull (e.g., the lower surfaces of the boat do not need to be planar).

A pressurization assembly is used to fill the bellows after a boat is positioned near/adjacent a dock and then to maintain a "constant" pressure (a pressure within an acceptable pressure range) to apply a stabilizing or restoring force to limit roll or pitch of the boat during unloading and loading. The constant pressure (or P2 in the following description) is often determined through experimentation with a particular boat and typical passenger loading so as to be high enough to almost lift the boat out of the water but not quite. In this manner, the bellows act to provide dynamic stabilization by supporting dynamic loads in the boat but not supporting the static load (or much of the static load), which is supported by water.

The stabilizing system provides a number of advantages. The stabilizing system reduces the number of underwater mechanisms used to stabilize the boat, thereby increasing the inherent reliability of the system and reducing maintenance costs and difficulty. The system does not require a precise alignment between the bellows or air bags (e.g., components of the hull supporting assembly) and the bottom of the boat, which decreases the time needed to load and unload the boat as stabilization can more quickly and effectively be achieved.

The stabilizing system provides large, compliant surfaces at the boat contact locations and does not, typically, support the static weight of the boat, which reduces the stress in the boat hull and minimizes the air pressure and energy needed to stabilize the boat. Further, the system alleviates pinch points between the side of the dock by limiting roll/pitch of the boat, which reduces the risk of passenger injury should a leg, arm, or the like be placed in the gap between the boat and the dock. The system does not require precise lateral positioning of the boat but still limits the possibility of propulsion components of the boat contacting components of the hull supporting assembly (e.g., a propeller does not strike the bellows or air bags).

More particularly, an apparatus is provided for supporting a boat hull during loading and unloading at a dock or other platform to control dynamic roll and pitch. The apparatus includes a hull support assembly including one or more pairs of bellows and a support structure positioning the bellows in first and second spaced apart positions within a waterway. The apparatus also includes a pressurization assembly for first supplying air to the pair of the bellows to maintain an internal pressure of the bellows at a first pressure and for second supplying the air to the pair of the bellows to maintain the internal pressure of the bellows at a second pressure greater than the first pressure. In use, the second pressure is maintained with the boat hull received by the hull support assembly with a contact surface of one of the bellows contacting a first exterior surface of the hull and another one of the bellows contacting a second, spaced-apart exterior surface of the hull.

In one embodiment, the second pressure is maintained with the boat hull at a first initial loading and at a second loading comprising 5 to 50 passengers. Typically, the system is implemented such that the bellows (e.g., air bags or the like) are each formed of a flexible material such as a cloth/fabric, a plastic, a rubber, or the like (or some combination thereof) that expands from a retracted configuration at the first pressure with a first height to an extended configuration with a second height greater than the first height at the second pressure, whereby the contact surfaces conform to a shape and texture of the first and second exterior surfaces of the hull. In some particular embodiments, the contact surfaces are toed-in toward each other at an angle of at least about 15 degrees to better mate with a boat hull shape. To better distribute loads and limit needs for accurate alignment, the contact surfaces of the bellows each may have an area of at least about 1 square foot.

According to another aspect of this description, the hull support assembly includes a second pair of bellows spaced apart from the pair of the bellows, whereby pitch of the boat hull is controlled when the bellows are maintained at the second pressure. In such implementations, the pressurization assembly is fluidically linked to the second pair of the bellows and concurrently maintains all of the bellows at the first and second pressures. In some cases, the pressurization assembly includes a pressure chamber with an interior volume in fluid communication with the pair of the bellows and further includes a piston actuator operable to position a piston within the pressure chamber to provide the first and second pressures in each of the bellows. In these cases, the system may further include a control assembly providing feedback control over operation of the piston actuator during the first and second supplying of the air. Then, the control assembly may operate the actuator to move the piston within the pressure chamber to move between the first and second pressures within a time period of less than about one second.

DETAILED DESCRIPTION

Figure 1:
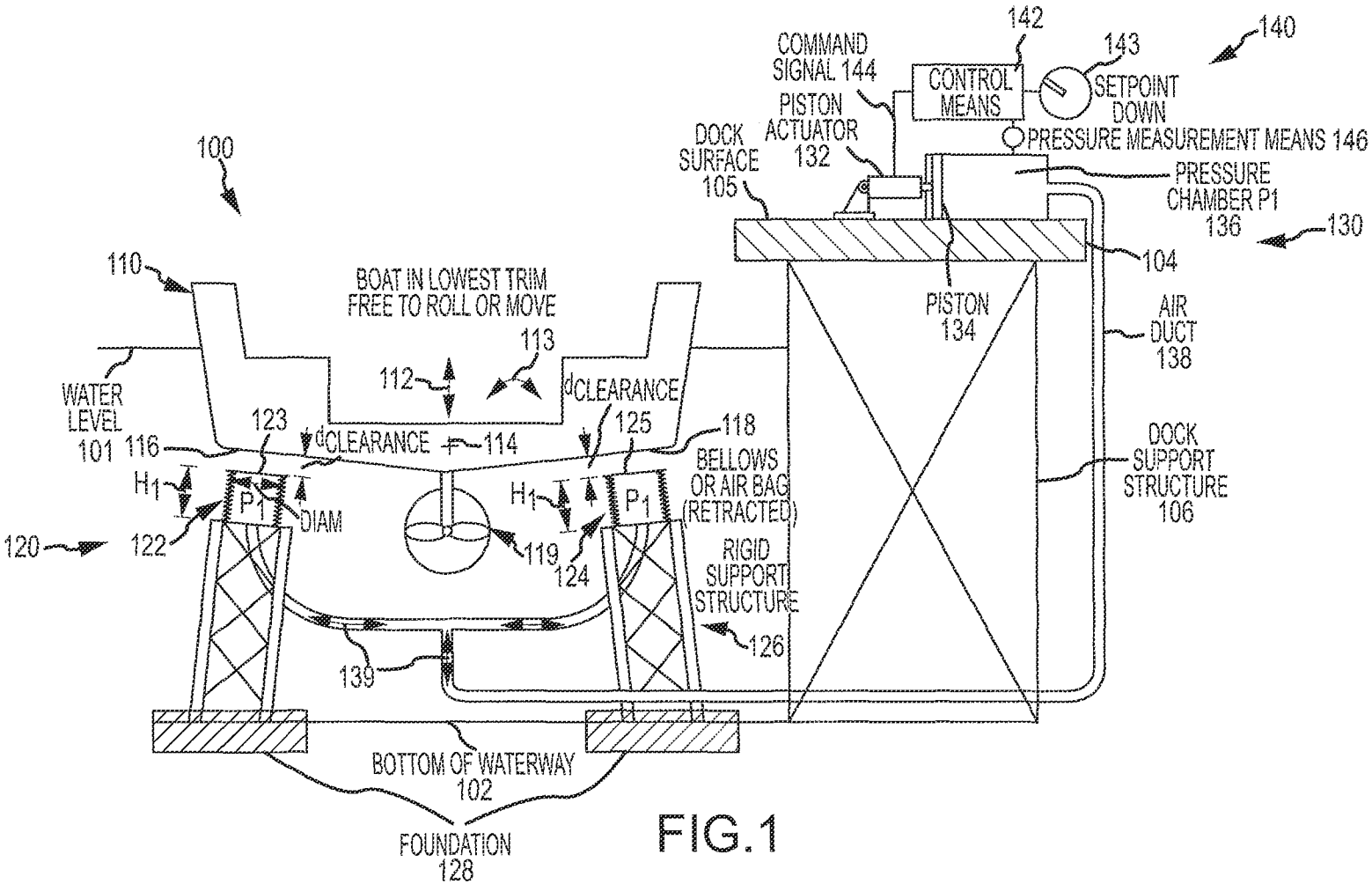
FIG. 1 illustrates a dynamic roll stabilizing system for use with a passenger boat (e.g., a small boat, dynamic roll stabilizer), with the system shown in a first or non-stabilizing mode of operation or operating state.

Briefly, the present description is directed toward a small boat dynamic roll (or pitch) stabilizer. In one embodiment, the stabilizer uses a combination of pairs of pneumatically interconnected underwater bellows (or air bags or the like) such as two or more pairs of left and right (port and starboard) bellows. The bellows are mounted on a fixed support structure that is in turn attached to the waterway bottom (e.g., to a foundation or bottom of a channel for an amusement park ride). The pairs of bellows are located to contact the outboard, underside surface of the boat (or its hull). The internal pressure of the bellows is controlled by an out-of-water pressurization assembly (or bellows/air bag fill system) so as to apply a stabilizing force (or restoring force) to the bottom of the boat during load and unload operations at a number of distributed locations, e.g., at each of the bellows on both sides of the boat hull and along the length of the hull such as with a forward pair of bellows and an aft pair of bellows.

During use, as a boat enters or leaves the load or unload position, the bellows (or air bags) are maintained by the pressurization assembly at a relatively low first pressure ($P_1$) to provide a desired clearance to ensure the upper surfaces of the bellows are clear of the underwater boat elements. Once the boat is stationary (and, in some cases, secured to the dock), the bellows or air bags are inflated with the pressurization assembly until their upper surfaces contact the bottom of the boat. Pairs of the bellows or air bags are located laterally apart from the centerline of the boat and are typically equidistally spaced from this the centerline. The bellows may also be positioned to be relatively close to or at the outer edges of the boat bottom as practical. This location of the left and right bellows is useful for limiting the magnitude of the restoring force that needs to be applied to limit or even eliminate dynamic roll during loading and unloading.

Prior to initiating and during loading and unloading, the pressurization assembly is operated to maintain the pressure in the bellows or air bags at a second pressure that is "constant" (e.g., within a pressure range about a second pressure setting such as plus or minus 5 psi relative to the pressure setting). As the boat bobs up and down, the height of the bellows varies to continue to apply the restoring force with the pressure remaining constant. In this manner, the bellows provide a stabilizing and/or dampening force against roll moments in the boat, which are induced as passengers step onto and off of the boat during loading and unloading operations. Multiple pairs of bellows or air bags may be used along the length of the boat (extending along the center line of the boat hull) to also dampen pitch moments and to add redundancy to the stabilizing system.

The bellows pressurization (or fill) assembly can be implemented in a variety of ways and is generally configured to quickly (e.g., about 1 second or less to fill and stabilize a boat) move the bellows or air bags into and out of position against a boat hull. The pressurization assembly is adapted to maintain the internal pressure of the bellows while the boat moves up and down due to passenger loading and unloading (e.g., while the load of the boat changes in magnitude and in location).

For example, the pressurization assembly may include a pressure chamber fluidically in communication with the bellows internal volume via a set of fill lines (or a fill manifold) such that the pressure chamber is a common volume with the air ducts/fill lines and bellows or air bags. Then, by manipulating a position of a piston in the pressure chamber with a piston actuator, the bellows or air bags can be inflated or deflated as required (or to reduce the pressure to move the bellows away from the hull to allow the boat to move away from the dock without interference). Once the bellows or air bags are in contact with the boat bottom, the pressure in the pressure chamber will increase.

The stabilizing system may include a control assembly to control the pressure in the pressure chamber and, therefore, within the bellows or air bags, by operating the piston actuator. The control assembly includes a feedback loop to maintain the pressure in the bellows or air bags constant (at P2 or a second pressure setting chosen for loading and unloading operations), and this causes the restoring force exerted on the boat by the contact surfaces of the bellows to also remain substantially constant. This acts to dampen the dynamic motion of the boat as it is loaded and unloaded (Le., as loads vary in magnitude and location in the boat).

The pressure and corresponding restoring forces may be initially adjusted for a particular stabilizing system so that only (or mostly) dynamic forces are stabilized or damped (e.g., to set a useful second pressure setting for use in load/unload of a particular boat or particular boat operations that may vary with numbers of passengers). The static load of the boat is typically not supported by the stabilizing system as the boat is allowed to continue to float on the water (e.g., the water supports the static load). The contact area between the bellows or air bags and the boat is preferably selected to be relatively large so as to minimize the required air pressure within the bellows or air bags and also to limit the stresses developed within the bottom of the boat (e.g., avoid point contacts and distribute force over a larger area as a boat hull typically is designed to withstand evenly distributed loading).

Figure 2:
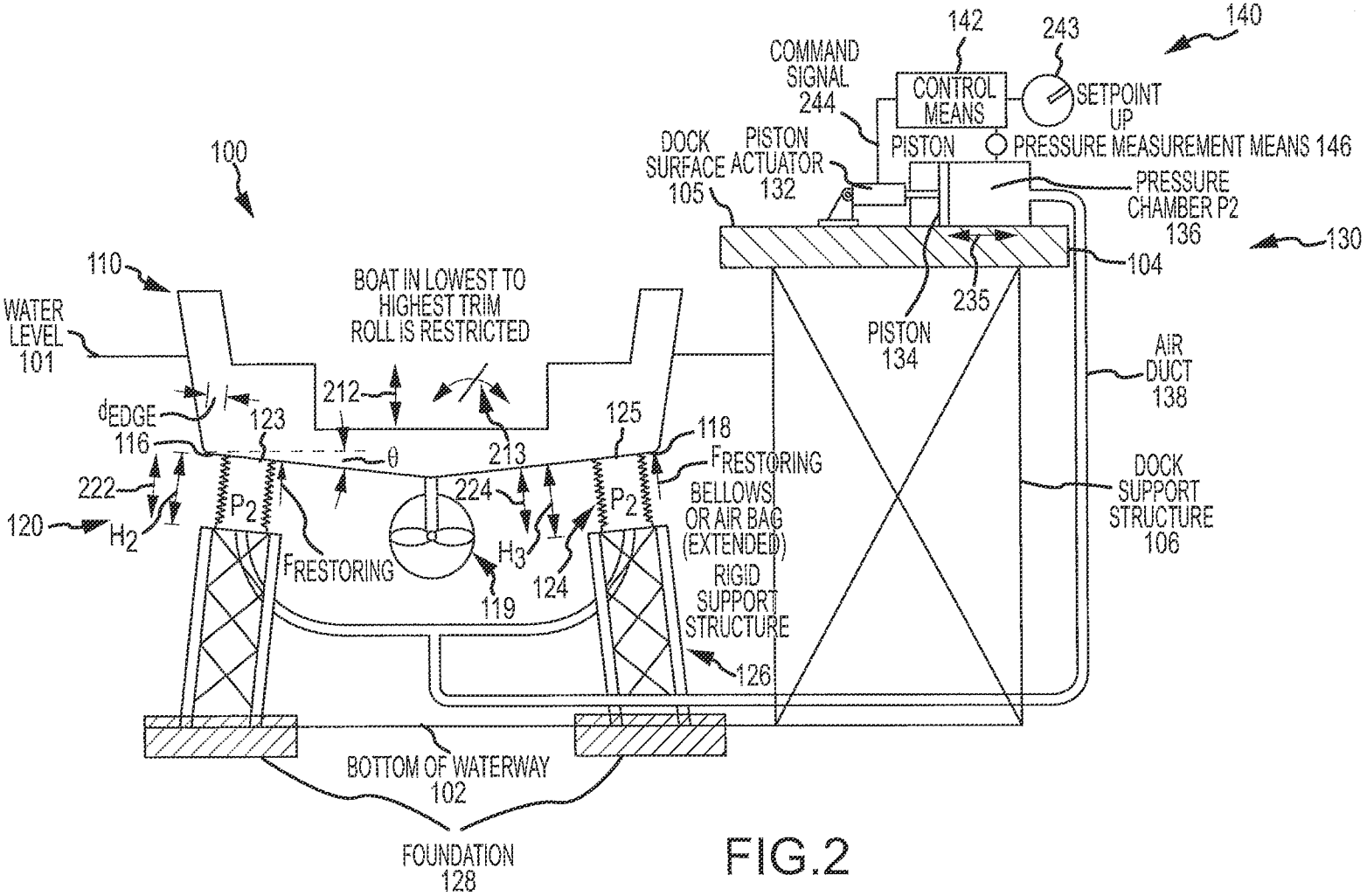
FIG. 2 illustrates the dynamic roll stabilizing system of FIG. 1, with the system shown in a second or dynamic pitch or roll stabilizing mode of operation or operating state.

FIGS. 1 and 2 illustrate one embodiment of a small boat dynamic pitch stabilizing system 100. FIG. 1 shows the system 100 in a first operating state in which a boat/hull 110 is not being supported by the system 100 as would be the case when a boat 110 approaches a dock 104 for unloading/loading or when the boat 110 is freed up for leaving the dock 104 after loading of passengers or equipment. FIG. 2 shows the system 100 in a second operating state in which the boat/hull 110 is supported by the system 100 to limit or nearly eliminate dynamic pitch (or roll) such as during unloading and loading of passengers (not shown) from an upper surface 105 of a dock or horizontal platform 104.

Turning first to FIG. 1, a small passenger boat (or boat hull) 110 is shown to be floating on water (with a water level shown at 101) so as to be statically supported by the water. By "small," it is meant that the boat 110 may be adapted for carrying 1 to 30 or more passengers as is the case for many water rides in amusement parks and for tour boats that are loaded and unloaded several-to-many times a day and for which it is desirable to make it safer for passengers to step on and off of the boat 110 from or to the dock surface 105. The water may flow or be contained in a waterway, channel, basin, lake, or the like with a natural or manmade bottom shown at 102. The dock or platform 104 has an upper or load/unload surface 105 at or above the water level 101 and is supported via a dock support structure 106, which may, in turn, be supported by the waterway bottom 102 (but this is not required for system 100).

In the first operating state, the boat 110 is positioned adjacent to the dock 104 and is wholly supported by the water in the waterway. The boat 110 may be free floating or may be guided to travel on a track (not shown) on the waterway bottom 102. The boat 110 is shown to be self-propelling with a drive mechanism (e.g., a propeller or the like) 119, and this drive mechanism 119 is used to move the boat 110 up near/against the dock 104. Hence, there typically is a need for tolerance in the exact position of the boat 110 relative to the dock 104 both along the length of the channel and with regard to the gap between the boat edge and the dock 104. In other words, the system 100 is preferably adapted to allow for a range of positions of the boat 110 during stabilizing operations (see FIG. 2) both along the hull centerline 114 and with regard to gap size between the hull 110 and the dock 104.

To this end, the system 100 includes a hull support assembly 120 that does not require exact alignment with the hull 110 to perform stabilization. The hull support assembly 120 includes at least one pair of pneumatically-filled bellows or air bags and typically will include two to four or more pairs of port and starboard (left and right) bellows extending along the length of the channel or hull centerline 114 to selectively support the dynamic load of the hull 110 during loading and unloading (such as when passengers move or when they step on or off the hull 110).

As shown, the hull support system 120 includes left/port bellows or air bag 122 and right/port bellows or air bag 124. These bellows 122, 124 make up a pair of bellows of support assembly 120, and each bellow 122, 124 is supported vertically within the water (or within the channel) upon a rigid support structure 126 that is, in turn, placed on foundations 128 on the waterway bottom 102. The bellows 122, 124 are spaced apart a distance or gap to allow the drive mechanism (prop) 119 to pass through without contact or interference.

The positioning of the bellows 122, 124 is selected such that the upper or contact surface 123, 125 of each bellow 122, 124 is proximate to an outer edge of the hull 110 such that when the bellows 122, 124 are inflated to contact the port and starboard (left and right) bottom surfaces 116, 118 of the hull 110 there is no or only a small distance to the hull edges (e.g., $d_{edge}$ shown in FIG. 2 is 0 to 12 inches or the like). This smaller gap near the edges allows less restoring force to be applied by the bellows 122, 124 to stabilize the hull 110 (as shown in FIG. 2).

Each bellow 122, 124 may take on a variety of shapes and be formed of a variety of materials to practice the system 100. For example, the bellows 122, 124 may be circular air bellows or air bags with a diameter, Diam, of 12 to 36 or more inches made of a durable but compliant material such as a cloth/fabric, a plastic, a rubber, or a combination thereof that may be selected to handle operating/fill pressures, to be resistant to and long-lived in water, and to meet other design requirements for the system 100.

As shown in FIGS. 1 and 2, the contact surfaces 123, 125 (which may be 1 to 3 square feet or more) are typically an equidistance from the centerline 114 of the hull 110 (or within a range of 4 to 12 inches from being equally spaced from the centerline 114 as may be measured from a center axis of the bellows 122, 124 to the centerline 114 or from an inner edge of the bellows 122, 124 to the centerline 114). This allows each of the bellows 122, 124 to further stabilize the boat 110 and resist the tendency of the hull 110 to pitch or roll with passenger movement toward and away from the dock 104 in the hull 110.

Further, the material is flexible to allow inflating and deflating such that each of the bellows 122, 124 provides a compliant contact surface 123, 125 for contacting lower hull surfaces 116, 118. In this way, the surfaces 116, 118 do not have to be wholly planar and include ridges, curves, fasteners, and the like without these raised surfaces becoming point contact surfaces, and the compliant contact surfaces 123, 125 better distribute applied stabilizing/restoring forces, $F_{Restoring}$. Additionally, as shown in FIG. 2, the bellows 122, 124 may be supported such that the contact surface 123, 125 are toed inward toward the centerline 114 at an angle, θ, that may be selected to suit a particular hull 110 or a range of lower surfaces 116, 118 (e.g., toe-in angle, θ, may be 15 to 45 degrees or the like) so as to provide better mating between the surfaces 123, 125 and hull surfaces 116, 118, respectively.

The positioning of the contact surface 123, 125 is controlled pneumatically by deflating or inflating the bellows 122, 124 with a pressurization assembly 130 (or bellows-fill or air-supply assembly). The pressurization assembly 130 is positioned out of the water 101 such as on the dock surface 105. The pressurization assembly 130 includes a pressure chamber 136 that is fluidically connected to the internal volumes of the two bellows 122, 124 via feed lines or ducts (or supply lines/ducts or manifold) 138. In other words, the chamber 136 is a common or shared volume of air (or other gas) relative to the lines 138 and bellows 122, 124 with air flow shown with arrows 139 into and out of the bellows 122, 124. In this manner, the pressure maintained in the pressure chamber 136 is also the pressure within the bellows 122, 124.

FIG. 1 illustrates the stabilization system 100 in a first operating mode in which gaps are maintained between the contact surfaces 123, 125 and bottom surfaces 116, 118 of the hull 110. The size, $d_{Clearance}$, of this gap or clearance may be several inches to a foot or more (with more clearance being useful when the waterline 101 and/or boat loading varies during operation of the system 100), and it is provided to avoid or limit contact between the surfaces 123, 125 as the boat 110 approaches and leaves the dock 104 (i.e., as the boat 110 is positioned over or moves away from the hull support assembly 120). In the first operating mode, the chamber 136 and, therefore, the bellows 122, 124 are maintained at a first, lower pressure, $P_1$, to cause the bellows 122, 124 to be relatively deflated or retracted and to have a first, smaller thickness or height, $H_1$, to provide a gap between the surfaces 123, 125 and the hull 110.

To set the pressure in the chamber 136, the pressurization assembly 130 includes a piston actuator 132 for moving a piston 134 within the pressure chamber 136. During operation of system 100, a volume of air (or other gas) is used to initially fill the chamber 136, ducting 138, and billows 122, 124. Then, the actuator 132 may be used to position the piston 134 to set the pressure in the chamber 136 such as to be retracted to the position shown in FIG. 1 to set the chamber pressure at a first, lower pressure, $P_1$, which may be determined by experimentation or calibrating an implementation of the system 100. Preferably, the configuration of the actuator 132, the piston 134, and chamber 136 are chosen such that the pressure may be rapidly changed or adjusted (e.g., changed from the first pressure, $P_1$, to a second pressure, $P_2$, and vice versa). For example, some embodiments of the pressurization assembly 130 support this pressurization adjustment being completed in less than several seconds and, in some cases, in less than 1 second. This rapid change allows a boat 110 to be rapidly supported by the support assembly 120 and then later released to allow the boat 110 to leave the dock 104.

A control system 140 is provided in the system 100 to maintain the pressure (e.g., $P_1$ or $P_2$) in the chamber 136 and, therefore, bellows 122, 124, and to change between pressures (e.g., between $P_1$ and $P_2$) when the system 100 changes from its first operating mode of FIG. 1 to its second operating mode of FIG. 2. The control system 140 provides control using pressure-based feedback (or has a feedback loop). To this end, a controller 142 is provided that operates to generate command signals 144 that are provided to the piston actuator 132 to position the piston 134 in chamber 136. The position of the piston 134 is adjusted to maintain a present set point or pressure setting as shown at 143.

In FIG. 1, the pressure setting is at a first, lower pressure, $P_1$, and a pressure measurement device (gauge or the like) 146 is used to provide a present pressure reading to the controller 142, which acts to compare the reading to the setting 143. Typically, when the reading deviates by a preset percentage or magnitude (which are used to set an acceptable pressure range for $P_1$ or $P_2$) a new control signal 144 is used to operate the actuator 132 to move the piston 134 and adjust the pressure up or down in chamber 136 (and in bellows 122, 124).

With the system 100 in the first operating mode shown in FIG. 1, the boat hull 110 is supported only by the water and is free to bob or move up and down as shown with arrow 112 due to changes in its static load and, more typically, simply due to water movement (waves at later level 101). The hull 110 is also free to move with pitch/roll as shown with arrow 113 (and also to yaw). The contact surfaces 123, 125 typically will not contact the bottom surfaces 116, 118 unless there is excessive roll 113 and/or bobbing 112.

Turning now to FIG. 2, the system 100 is shown to be operating in a second operating mode in which the boat hull 110 is supported or stabilized such as during loading and unloading of passengers from the dock surface 105 of dock 104. Particularly, the set point or pressure setting 243 is increased to a second value or pressure, $P_2$, such that the controller 142 acts to transmit a different set of command signals 244 to operate the piston actuator 132 to quickly and initially extend out the piston 134 (e.g., in less than 1 second) and then to move it as shown with arrow 235 to maintain the pressure within chamber 136 and bellows 122, 124 at the second pressure, $P_2$ (e.g., using the feedback process discussed above).

Increasing the pressure in bellows 122, 124 from the first to the second pressure ($P_1$ to $P_2$) causes the bellows 122, 124 to inflate and expand as shown with arrows 222, 224 from a first thickness or height, $H_1$, to a second thickness or height, $H_2$ and $H_3$ (note, the two bellows heights, $H_2$ and $H_3$, may differ for the bellows such as when the loading of the hull 110 is unequal). This causes the contact surfaces 123, 125 to abut or contact the lower hull surfaces 116, 118 and the pressure to increase in the bellows 122, 124 until the second pressure, $P_2$, is reached in the bellows 122, 124 and chamber 136 as shown by pressure measurement device 146 (e.g., the controller 142 determines the reading from device 146 is at the upper set point 243 (or within an acceptable range about such a setting such as plus or minus several psi or up to a 10 percent variance or the like)).

The surfaces 123, 125 are compliant and take or conform to the shape of the surfaces 116, 118 as the bellows 122, 124 apply restoring or stabilizing forces, $F_{Restoring}$, to the hull 110. Again, the shape and size of the surfaces 123, 125 can vary to implement system 100 with some useful shapes being circular, square, and rectangular and sizes ranging from 0.5 to 1 square foot up to 3 square feet or more per bellow 122, 124, with larger sizes being useful for distributing the stabilizing forces, $F_{Restoring}$, over a larger area to limit stress in hull 110.

For example, a boat 110 may be 6000 pounds unloaded and 8000 pounds loaded such that each of 4 bellows (when system 100 includes two pairs of bellows 122, 124) may provide a restoring force of up to about 2000 pounds with 1 square foot surface areas 123, 125. In this example, the second pressure, $P_2$, may be set at 20 psi or may be set lower such that only dynamic forces are supported such as at 60 to 80 percent of the full static load in hull 110 (hull, equipment, and passengers). As can be seen, the larger the surface area of contact surfaces 123, 125 the lower the second pressure will need to be to stabilize dynamic pitch of a hull 110.

As can be seen in FIG. 2, the second pressure may be chosen such that the static load in the hull 110 is supported by the water in the channel as is shown with arrow 112 indicating the boat hull 110 may still rise and fall in the water relative to the water level 101. However, dynamic pitch or roll is limited or even prevented as shown with the crossed-through arrow 213. In other words, the second pressure, $P_2$, is chosen to be high enough that little or no roll or pitch of hull 110 occurs during changes in loading of hull 110 as occurs during loading and unloading of passengers onto the dock 104.

During the operations of system 100 in FIG. 2, the pressure, $P_2$, is maintained by the operation of the pressurization assembly 130 with control assembly 140 (feedback control). The bellows 122, 124 may inflate or deflate as the load changes, though, in hull 110 as is shown with arrows 222, 224 and the heights, $H_2$ and $H_3$, may change within a range or lowest trim to highest trim of the hull 110. For example, an unloaded boat 110 may extend outward from water level 101 a first amount (such as 2 to 4 feet as measured to an upper edge of a side of the hull 110) but then extend outward from water level a second, smaller amount (such as 1 to 3 feet) when fully loaded. By maintaining the pressure at the second pressure, $P_2$, which is less than that needed to lift an unloaded boat 110 out of the water (such as 80 to 90 percent of the unloaded boat load or 60 to 80 percent of the fully loaded boat 110 in some cases), the system 100 is able to provide support over dynamic loads in the hull 110 while allowing static loads to be supported by the water and the hull 110 to move 212 up and down in the water.

As discussed above, a single pair of bellows (such as bellows 122, 124) may be used in a hull support assembly (such as assembly 120) if the contact surfaces are large enough relative to the hull's lower surface area. However, in some embodiments, it may be useful to use 2 to 4 or more pairs of bellows or air bags spaced apart along the length of a received and supported boat hull so as to limit the need for alignment of the boat over the support assembly and to better distribute the stabilizing forces applied to the hull surfaces.

Figure 3:
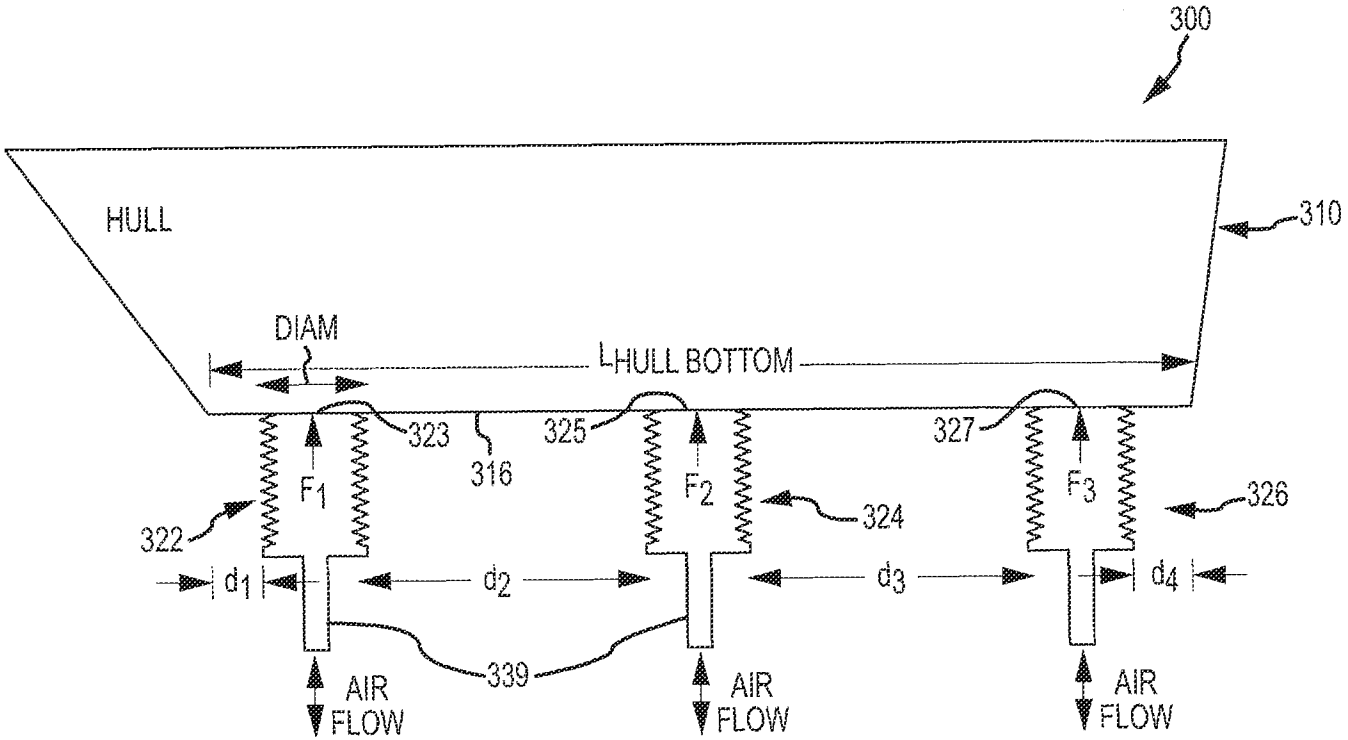
FIG. 3 illustrates in simplified form (schematic form) a side view of a portion of a stabilizing system (such as the system of FIGS. 2 and 3) showing use of three pairs of air bellows to provide dynamic pitch stabilization such as during loading and unloading of a passenger boat.

With the above in mind, FIG. 3 illustrates a side view of a portion of a small passenger boat stabilizing system 300 of an embodiment of the present description. As shown, a hull 310 is positioned over a hull support assembly made up of three pairs of bellows or air bags. With the side view of FIG. 3, the left or port bellows 322, 324, 327 in each of the three pairs of bellows can be seen.

The system 300 is operating in the second mode of operation to stabilize the hull 310 from pitching when it is dynamically loaded (e.g., movement of passengers or the like in hull 310). As discussed, for example, with reference to FIG. 2, a pressure (e.g., $P_2$) is maintained in the bellows 322, 324, 326 to cause the bellows 322, 324, 326 to apply restoring forces, $F_1$, $F_2$, and $F_3$ on the bottom surface 316 of the hull 310. To this end, air flow as shown is used to inflate the bellows 322, 324, 326 in a concurrent manner with one or more pressurization assemblies via inlet lines/ducts 339 which inflates the bellows 322, 324, 326 until the upper or contact surfaces 323, 325, 327 abut or contact the surface 316, conform to the surface shape/texture, and a pressure (e.g., $P_2$) is reached (as measured/sensed by a pressure measuring device in a control assembly for the one or more pressurization assemblies of system 300).

As shown, the first or forward bellow 322 (or first pair) is positioned a relatively small distance, $d_1$, from the front edge/end of the bottom surface 316 (such 6 inches to 2 feet from the front edge) while the third or aft bellow 326 (or third/aft pair) is a similar small distance, $d_4$, from the rear edge/end of the bottom surface 316 (such as 6 inches to 2 feet from the rear/aft edge). The placement of these 2 bellows 322, 326 allows the system 300 to limit forward and backward tipping or pitch of the hull 310 during loading and unloading (dynamic loading) of the hull 310. These positions of bellows 322, 326 also distribute the application of restoring forces, $F_1$ and $F_3$, on lower surface 316 to limit stresses in the hull 310.

The use of the intermediate or second bellow 324 (or second pair) positioned between the two bellows 322, 326 further acts to distribute restoring forces by providing force, $F_2$, applied centrally on hull 310 on surface 316 (such as at the central portion of hull surface 316 as determined by hull bottom length, $L_{Hull\ Bottom}$). The bellows 322, 324, 326 may be spaced apart in an unequal manner ($d_2$ does not equal $d_3$) or more typically equidistally (the spacing between adjacent bellow pairs is equal with $d_2$ equal to $d_3$) to more uniformly apply stabilizing forces. As discussed above, the diameter, Diam, or size and shape of the contact surfaces 323, 325, 327 may be varied to practice the system 300 (such as 1 square foot or more of contact area provided per bellow 322, 324, 326). The spacing between bellows may also be varied and the use of three pairs of bellows as shown in FIG. 3 is only exemplary with other embodiments using 2, 4, 5, or more pairs of bellows or air bags to stabilize a hull 310.

In the system 100 of FIGS. 1 and 2, a single pressurization assembly 130 and control assembly 140 was used to maintain pressures in all bellows in the system 100. In other embodiments, though, it may be desirable to provide bellow and feedback control on a bellow pair basis. Such a system (not shown) may repeat the arrangement shown for system 100 for each bellow pair. In other cases, though, it may also be useful to provide fill and feedback pressure control for each bellow or air bag in the stabilization system. This requires additional equipment such as pressure chambers, piston actuators, and controllers to be provided, but such an arrangement provides the advantage of facilitating use of lower pressure settings (e.g., a lower $P_2$) that allows for smaller piping/ducting and other equipment such as the pressurization assembly's actuator and pressure chamber to be smaller for each bellow or air bag (e.g., if $P_2$ were 20 psi in system 100 with 3 pairs of bellows, the use $P_2$ value may be divided by six or be one sixth as large in a pressurization/control per bellow configuration).

Figure 4:
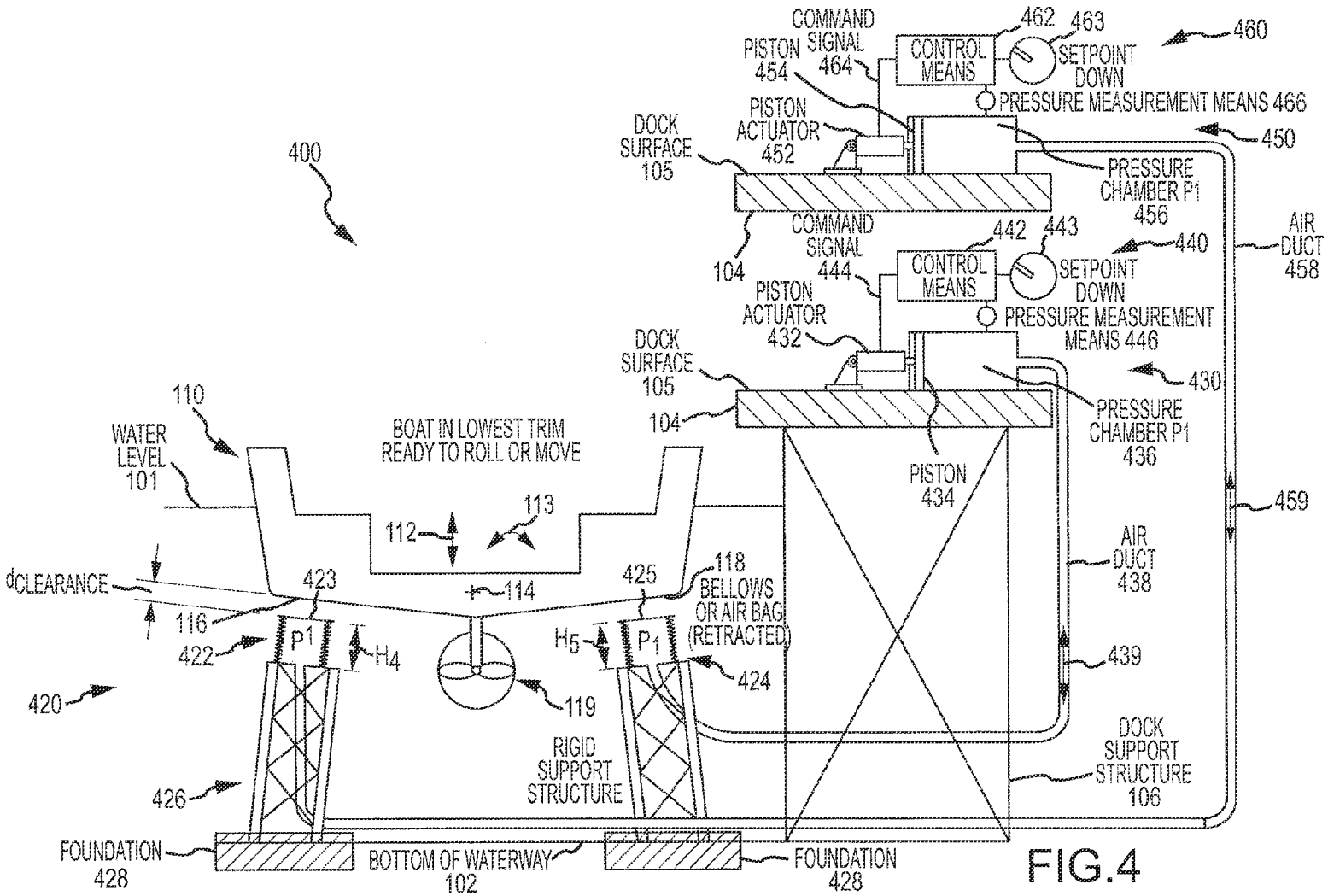
FIG. 4 illustrates a stabilizing system similar to that of FIG. 1 that provides a separate pressurization assembly with feedback control for each of the bellows or air bags in the boat support assembly, with the system being shown in a first or non-stabilizing mode of operation (e.g., as a boat initially approaches a dock or after loading is completed and stabilization released)
Figure 5:
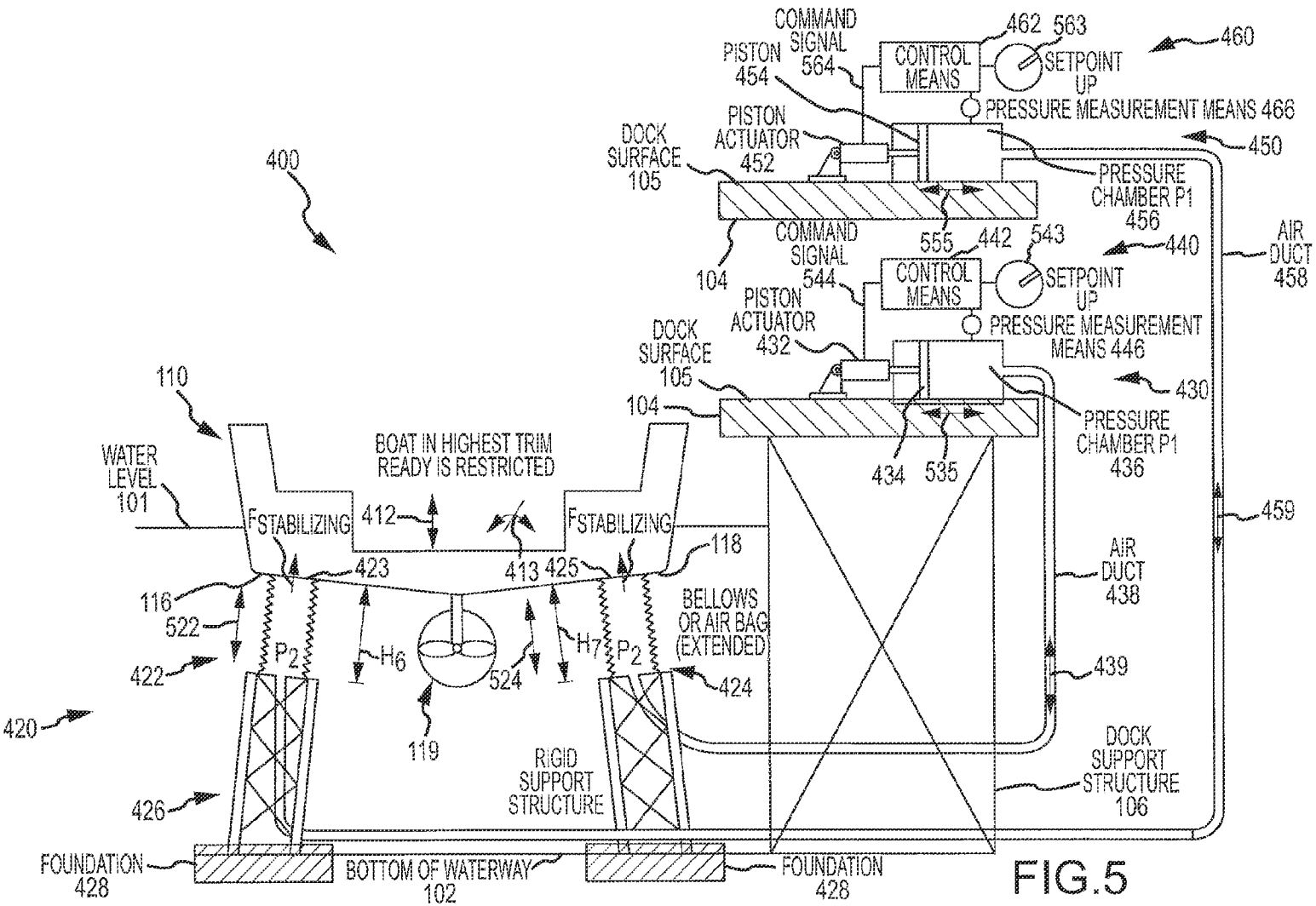
FIG. 5 illustrates the stabilizing system of FIG. 4, with the system shown in a second or dynamic pitch stabilizing mode of operation.

With that in mind, FIGS. 4 and 5 illustrate a stabilizing system 400 for use in stabilizing passenger boats such as boat 110. FIG. 4 shows the bellows 422, 424 of hull support assembly 420 in a retracted or deflated position with heights, $H_4$ and $H_5$ (typically equal heights) such that contact or support surfaces 423, 425 are spaced apart a distance from the lower hull surfaces 116, 118. The hull support assembly 420 is similar to assembly 120 in that it includes a rigid support structure 424 supporting each bellow 422, 424 in a spaced apart location in the channel (and under water with the channel being filled to a water level 101), and the structure 424 is mounted to foundation 428 on the waterway bottom 102.

In contrast to system 100, the system 400 includes first and second pressurization assemblies 430, 450 with fill lines 438, 458 that move and pressurize air (or another gas) as shown at 439, 459 to maintain a first lower pressure, $P_1$, in the bellows 422, 424. Each pressurization assembly 430, 450 includes a pressure chamber 436, 456 that is maintained at the first, lower pressure, $P_1$, and is a common volume with one of the bellows 422 or 424.

The pressure in each chamber 436, 456 is maintained by a control assembly 440, 460, respectively, with a feedback loop made up of a pressure measurement device 446, 466 that provides a pressure reading for chamber 436, 456 (and adjoining bellow 422, 424) to a controller 442, 462. The controller 442, 462 determines if the present pressure matches the low set point 443, 463 (i.e., $P_1$ or within a range about a set point). If not, a control signal 444, 464 is transmitted to a piston actuator 444, 464 to move a piston 434, 454 in the chamber 436, 456 to adjust the pressure to be the first pressure, $P_1$. In the first operating mode, the boat hull 110 is only supported by the water in the channel or waterway such that it may bob up and down as shown with arrow 112 or pitch (and yaw) as shown with arrow 113.

FIG. 5 illustrates the system 400 being operated in a second operating mode to support and stabilize the hull 110 to reduce or eliminate roll as shown with cross-out arrow 413 (and, typically, to limit pitch with two or more pairs of bellows extending along the length of the hull 110 in a spaced apart manner as shown in FIG. 3) but yet allow some bobbing up and down as shown with arrow 412. The pressurization assemblies 430, 450 may be concurrently operated with controllers 442, 462 to increase the pressure in the bellows 422, 424 to a second pressure, $P_2$, that is high enough to limit dynamic pitch but allow the boat to move up and down as shown by arrow 412 (e.g., the water in the waterway provide support of static loading of the hull 110). For example, the second pressure, $P_2$, may be a fraction of the static load with the boat 110 full or unloaded (e.g., 60 to 80 percent of one of these loads) to nearly lift the boat up when unloaded but not quite.

The second pressure, $P_2$, is achieved by the actuators 544, 564 operating concurrently (or at least partially concurrently) to move the pistons 434, 454 as shown at 535, 555 until the contact surfaces 423, 425 contact the surfaces 116, 118 and the pressure in chambers 436, 456 (as measured by devices 446, 466) increases to $P_2$. This causes the bellows 422, 424 to increase in height to second heights, $H_6$ and $H_7$, that may vary during operations between a low trim of hull 110 and high trim of hull 110 (as shown in FIG. 5 as may correspond with an unloaded or lightly loaded boat such as at the end or beginning of an amusement park ride when just the captain and/or crew or cast is loaded).

The heights, $H_6$ and $H_7$, may be substantially equal such as when loading is well distributed in the vehicle (no dynamic loading) but often will differ during loading such as when passengers are moving from the dock 104 onto the boat 110 (dynamic loading is applied with moving passengers about the hull 110). The bellows 422, 424 act in combination but independently to apply restoring forces, $F_{Restoring}$, on the port and starboard surfaces 116, 118 of the hull 110 when the pressure, $P_2$, is maintained (concurrently but also independently via operation of pressurization assemblies 430, 450 and control assemblies 440, 460).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. An apparatus for dampening the motion of a boat hull during loading and unloading at a dock or other platform to control dynamic roll and/or pitch, comprising:

a hull support assembly including a pair of bellows and a support structure positioning the bellows in first and second spaced apart positions within a waterway; and a pressurization assembly for first supplying air to the pair of the bellows to maintain an internal pressure of the bellows at a first pressure and for second supplying the air to the pair of the bellows to maintain the internal pressure of the bellows at a second pressure greater than the first pressure, wherein the second pressure is maintained with the boat hull received by the hull support assembly with a contact surface of one of the bellows contacting a first exterior surface of the hull and another one of the bellows contacting a second, spaced-apart exterior surface of the hull and wherein the pressurization assembly includes a pressure chamber with an interior volume in fluid communication with the pair of the bellows and further includes a piston actuator operable to position a piston within the pressure chamber to provide the first and second pressures in each of the bellows.

2. The apparatus of claim 1, wherein the second pressure is maintained with the boat hull at a first initial loading and at a second loading comprising 5 to 50 passengers.

3. The apparatus of claim 1, wherein the bellows comprises a flexible material that expands from a retracted configuration with a first height at the first pressure to an extended configuration with a second height greater than the first height at the second pressure, whereby the contact surfaces conform to a shape and texture of the first and second exterior surfaces of the hull.

4. The apparatus of claim 3, wherein the contact surfaces are toed-in toward each other at an angle of at least about 15 degrees.

5. The apparatus of claim 3, wherein the contact surfaces of the bellows each has an area of at least about 1 square foot.

6. The apparatus of claim 1, wherein the hull support assembly includes a second pair of bellows spaced apart from the pair of the bellows whereby yaw of the boat hull is controlled when the bellows are maintained at the second pressure and wherein the pressurization assembly is fluidically linked to the second pair of the bellows and concurrently maintains all of the bellows at the first and second pressures.

7. The apparatus of claim 1, further including a control assembly providing feedback control over operation of the piston actuator during the first and second supplying of the air, wherein the control assembly operates the actuator to move the piston within the pressure chamber to move between the first and second pressures within a time period of less than about one second.

8. A boat dynamic pitch stabilizer, comprising:

at least two pairs of aft and forward air bags positioned in a spaced apart and linear arrangement so as to have a contact surface of each of the air bags below a water level of water received in a waterway for a passenger boat;

an air bag fill assembly comprising a pressure chamber in fluid communication with each of the air bags and further comprising a piston within the pressure chamber and an actuator for selectively positioning the piston within the pressure chamber to change a pressure within the pressure chamber and the air bags from a first pressure to a second pressure, wherein the contact surfaces apply stabilizing forces on a bottom of the passenger boat when the passenger boat is positioned above the air bags in the waterway and when the pressure chamber is maintained at the second pressure.

9. The stabilizer of claim 8, wherein the contact surfaces are formed of a material that substantially conforms to a shape of the bottom of the passenger boat as the stabilizing forces are applied to the passenger boat.

10. The stabilizer of claim 8, wherein the changing from the first to the second pressure is performed by the air bag fill assembly in less than 1 second.

11. The stabilizer of claim 8, wherein the second pressure is selected based on static and dynamic loading of the passenger boat whereby the stabilizing forces support the dynamic loading and the water in the waterway supports at least 60-90 percent of the static load.

12. The stabilizer of claim 8, wherein the pressure chamber, interior spaces of the air bags, and an interior volume of piping connecting the pressure chamber to the interior spaces of the air bags are arranged to provide a common volume of air.

13. The stabilizer of claim 12, further comprising a control assembly including a pressure measurement device measuring the pressure in the pressure chamber and further including a controller generating control signals for the actuator to maintain the pressure in the pressure chamber first within a range about the first pressure and second within a range about the second pressure.

14. A method of providing dynamic stabilization of a passenger boat, comprising:

positioning the passenger boat in a waterway filled with water in a load and unload position adjacent a dock and over a hull support assembly comprising pairs of air bellows, wherein the air bellows are in a retracted position;

first inflating the air bellows until each of the air bellows contact a bottom of the passenger boat; and second inflating each of the air bellows until a pressure within each of the air bellows is within a predefined pressure range, wherein the second inflating comprises sensing a pressure in a pressure chamber in fluid communications with all of the air bellows and operating a piston actuator to move a piston in the pressure chamber to maintain the pressure in the pressure chamber within the predefined pressure range.

15. The method of claim 14, wherein the second inflating is performed within 1 second.

16. The method of claim 14, wherein the air bellows are spaced apart with at least two contacting a port side of the bottom of the passenger boat and with at least two contacting a starboard side of the bottom of the passenger boat and wherein the air bellows each provides a contact surface for contacting the bottom of the passenger boat that is at least 1 square foot in area.

17. A method of providing dynamic stabilization of a passenger boat, comprising:

positioning the passenger boat in a waterway filled with water in a load and unload position adjacent a dock and over a hull support assembly comprising pairs of air bellows, wherein the air bellows are in a retracted position;

first inflating the air bellows until each of the air bellows contact a bottom of the passenger boat; and second inflating each of the air bellows until a pressure within each of the air bellows is within a predefined pressure range, wherein the second inflating comprises sensing a pressure in a plurality of pressure chambers each in fluid communication with one of the air bellows and independently operating piston actuators to move pistons in the pressure chambers to maintain the pressures in the pressure chambers within the predefined pressure range.

18. The method of claim 17, wherein the second inflating is performed within 1 second.

19. The method of claim 17, wherein the air bellows are spaced apart with at least two contacting a port side of the bottom of the passenger boat and with at least two contacting a starboard side of the bottom of the passenger boat and wherein the air bellows each provides a contact surface for contacting the bottom of the passenger boat that is at least 1 square foot in area.

20. A method of providing dynamic stabilization of a passenger boat, comprising:

positioning the passenger boat in a waterway filled with water in a load and unload position adjacent a dock and over a hull support assembly comprising pairs of air bellows, wherein the air bellows are in a retracted position;

first inflating the air bellows until each of the air bellows contact a bottom of the passenger boat; and second inflating each of the air bellows until a pressure within each of the air bellows is within a predefined pressure range, wherein the second inflating comprises using a feedback controller to maintain the pressure within each of the air bellows.

21. The method of claim 20, wherein the second inflating is performed within 1 second.

22. The method of claim 20, wherein the air bellows are spaced apart with at least two contacting a port side of the bottom of the passenger boat and with at least two contacting a starboard side of the bottom of the passenger boat and wherein the air bellows each provides a contact surface for contacting the bottom of the passenger boat that is at least 1 square foot in area.

* * * * *